US008607507B2

(12) United States Patent
Anderson

(10) Patent No.: US 8,607,507 B2
(45) Date of Patent: Dec. 17, 2013

(54) BRACKET DEVICE FOR MOUNTING ON A ROOF

(75) Inventor: Terry E. Anderson, Highland, UT (US)

(73) Assignee: TRA Snow Brackets, Inc., American Fork, UT (US)

( * ) Notice: Subject to any disclaimer, the term of this patent is extended or adjusted under 35 U.S.C. 154(b) by 1459 days.

(21) Appl. No.: 10/843,060

(22) Filed: May 11, 2004

(65) Prior Publication Data

US 2005/0102958 A1 May 19, 2005

Related U.S. Application Data

(60) Provisional application No. 60/520,934, filed on Nov. 17, 2003.

(51) Int. Cl.
*E04D 13/00* (2006.01)

(52) U.S. Cl.
USPC ..... 52/26; 52/25; 248/535

(58) Field of Classification Search
USPC ..... 52/24, 25, 26; 248/512, 535
See application file for complete search history.

(56) References Cited

U.S. PATENT DOCUMENTS

| | | | | |
|---|---|---|---|---|
| 529,774 | A * | 11/1894 | Baird | 52/25 |
| 1,230,363 | A * | 6/1917 | Baird | 52/25 |
| 2,079,768 | A * | 5/1937 | Levow | 52/25 |
| 5,222,340 | A * | 6/1993 | Bellem | 52/463 |
| 6,318,028 | B2 * | 11/2001 | Alley | 52/25 |
| 6,453,623 | B1 * | 9/2002 | Nelson et al. | 52/24 |

FOREIGN PATENT DOCUMENTS

| | | | | |
|---|---|---|---|---|
| DE | 2523087 | A1 * | 5/1975 | E04D 13/10 |
| DE | 3617225 | A1 * | 11/1987 | |
| DE | 3716491 | A1 * | 12/1988 | |
| DE | 3723020 | A1 * | 1/1989 | |

* cited by examiner

*Primary Examiner* — Jeanette E Chapman
*Assistant Examiner* — Daniel Kenny
(74) *Attorney, Agent, or Firm* — Thorpe North & Western LLP

(57) ABSTRACT

A system is provided for mounting on a standing seam of a roof and supporting a snow fence rail. A first surface of the bracket is oriented toward the standing seam and includes a first plurality of protrusions that are abutted against the standing seam. An opening configured to receive a snow fence rail is located in the bracket above the first plurality of protrusions. A second surface of the bracket is oriented opposite the first surface of the bracket, and a fastener is configured to secure the bracket to the roof by pressing the plurality of protrusions into the standing seam roof.

1 Claim, 13 Drawing Sheets

BRACKET DEVICE FOR MOUNTING ON A ROOF

This non-provisional application claims priority to U.S. application No. 60/520,934 filed Nov. 27, 2003.

FIELD OF THE INVENTION

The present invention relates generally to bracket devices that mount on a standing seam roof and support snow fence rails.

BACKGROUND OF THE INVENTION

Metal roofs with standing seams or simulated standing seams have long been in use in the United States and throughout the world. Standing seam metal roofing can be seen on almost every type of building, from shopping centers to schools, churches to libraries, and skyscrapers to homes. The popularity of standing seam roofing continues to grow because standing seam roofs are weather-tight, energy efficient, durable, cost effective, and environmentally friendly. Standing seam roofs are often made of steel sheets installed at a slope, which assures water runoff and allows snow or ice to easily slide from the roof.

Snow often accumulates on a standing seam roof until the snow and ice melts or until the weight of the snow causes it to slide off the roof. The snow may also slide off the roof when the sun begins to melt the snow from above or heat from the building below melts the snow from beneath. A metal roof may also conduct heat from a part of the roof that is exposed to the sun and this will melt the snow and ice from beneath. As the snow and ice melts, this can produce sliding snow and ice masses. When the snow or ice masses slide off the roof, the snow and ice can come off in large pieces and cause damage to gutters, property, and the roof itself. In some cases, this falling snow and ice can even cause injury or death to people standing underneath the roof. The snow that falls off can also block entrances or curl back and break windows, gas meters, or other building fixtures.

Architects often try to circumvent the danger of snow and ice falling on people and property by adding dormers to a roof design. However, dormers can cause more problems than they fix. Dormers can reduce or eliminate proper ventilation causing ice dams in the valleys and leaks in the roof. Icicles can form easily in the corners and create even greater potential for damage to gutters, roofs, people, and property below. Dormers also increase the points of potential damage on a roof by creating tangents and valleys where snow and ice can strike, and dormers may even be torn off by sliding snow and ice masses.

Some solutions to this problem do not require a change in the design of the building. For example, snow guards or fences can be used in order to try to keep snow banks or ice sheets retained on the roof until they melt. Snow guards have been designed for attaching to the flat surface of the roof, and some snow guards have been designed for attaching to the roof seams. Although the guards or fences may be partially effective, manufacturers do not typically engineer these devices to the fail point of the roof structure or the roofing fasteners. Manufacturers often know when the guard or fence will fail, but do not know when the roofing fasteners, sheathing, the roofing product, or the roof will fail.

In addition, some snow guards and snow fences are not properly engineered to withstand heavy snow loads. When the snow guards or fences strain under the load and break (or come unfastened) these fence and bracket systems often fail completely. This can result in greater property damage and potential risk.

SUMMARY OF THE INVENTION

The present invention provides a bracket for mounting on a standing seam of a roof and supporting a snow fence rail. A first surface of the bracket is oriented toward the standing seam and includes a first plurality of protrusions that are abutted against the standing seam. An opening configured to receive a snow fence rail is located in the bracket above the first plurality of protrusions. A second surface of the bracket is oriented opposite the first surface of the bracket, and a fastener is configured to secure the bracket to the roof by pressing the plurality of protrusions into the standing seam roof.

DETAILED DESCRIPTION

Figure 1:
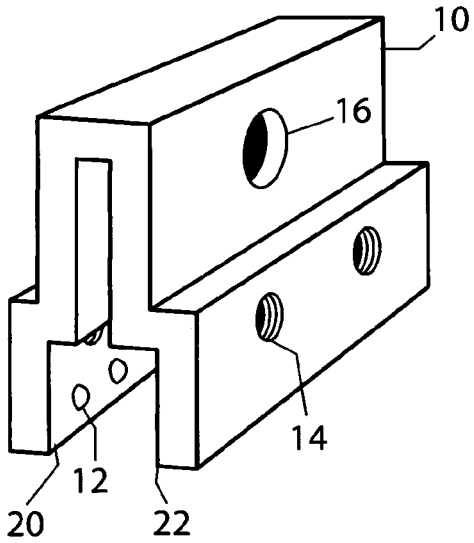
FIG. 1 is a perspective view of a folded single plate bracket in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one, skilled in the relevant art and having possession of this disclosure, are to be considered within the scope of the invention.

The present invention provides a bracket for attaching on a standing seam roof and supporting a snow fence rail. The bracket can support a snow fence rail in a manner that allows the snow fence to withstand heavier snow loads than brackets that are currently available. One reason for the strength of the bracket of the present invention is that the bracket is not held to the roof using screws or other traditional fasteners where the screw threading can be stripped or the roof structure may be punctured. Instead, the bracket of the present invention is held to the roof by a plurality of protrusions that extend from the surface of the bracket and press into the standing seam.

The snow fence bracket has two opposing surfaces that clamp to a standing seam. When the snow fence bracket is attached to a roof seam, a first surface is adjacent to one side of a standing seam, and a second surface is adjacent to the other side of the standing seam. The first surface includes a plurality of protrusions that are abutted against one side of the standing seam. For additional strength, the second surface can also include a plurality of protrusions that are abutted against the other side of the standing seam. The plurality of protrusions are pressed into the standing seam of the roof, and a fastener secures the first and second surfaces together while holding the plurality of protrusions against the seam.

Figure 2:
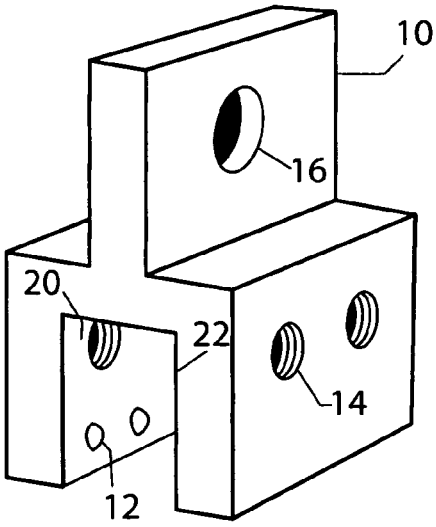
FIG. 2 is a perspective view of a forked single plate bracket in accordance with an embodiment of the present invention.
Figure 3:
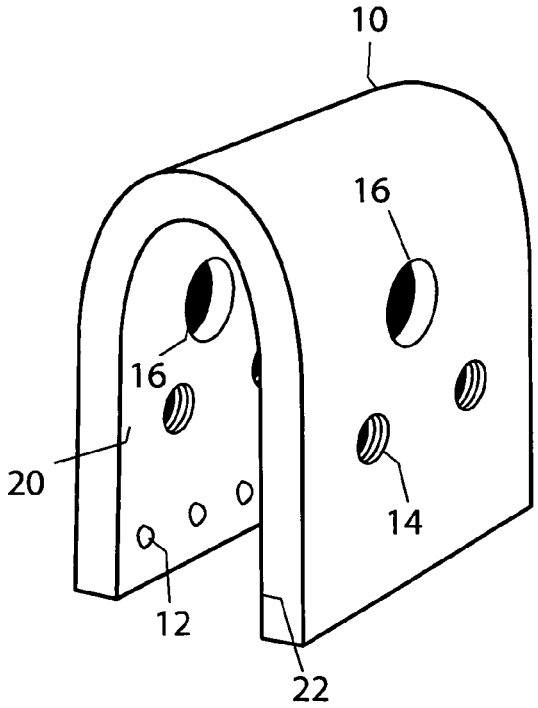
FIG. 3 is a perspective view of a curved single plate bracket in accordance with an embodiment of the present invention.

According to the embodiments of the present invention shown in FIGS. 1-3, a bracket 10 can be formed from a single piece of material with a first surface 20 opposite a second surface 22. The first and second surfaces are configured to be oriented toward a standing seam of a standing seam roof, with the first surface on one side of the standing seam and the second surface on the other side of the standing seam.

The first surface includes a plurality of protrusions 12 that are configured to press into one side of the standing seam. According to one embodiment of the invention, the second surface may include a plurality of protrusions that are configured to press into the other side of the standing seam. The plurality of protrusions are pressed into the standing seam and held in place by a fastener 14 that secures or clamps the first and second surfaces at a fixed distance from each other. The fastener can be a threaded bolt, a latch, a screw, a bolt with a retaining pin, or any other type of fastener used for fastening two plates together.

FIG. 1 is a bracket that is pressed or folded to fit over a standing seam. FIG. 2 illustrates a bracket formed in a fork shape, wherein the fasteners 14 are at the top portion of the fork. FIG. 3 shows a bracket formed from a single piece of material that is curved so that one end of the bracket fits against one side of the standing seam and the other end of the bracket can fit against the other side of the standing seam. In each of these embodiments, the distance between the first surface and the second surface can be equal to or slightly more than the width of the standing seam in order to ensure a tight fit over the standing seam.

The bracket can include an opening 16 located above the first plurality of protrusions. In the embodiments depicted in FIG. 1 and FIG. 3, two openings are made, one in each side of the bracket. The opening or openings are configured to receive a snow fence rail. An opening does not necessarily need to be round or entirely surround the snow fence. For example, the opening could be U shape in which the snow fence sits. The snow fence rail can be a bar, a pipe, or any other type of rail with sufficient strength to hold snow and ice on a roof. Snow fence rails can be circular (as illustrated in the drawings), triangular, square, hexagonal or any other useful geometric shape that can be formed into a fence rail. In addition, the snow fence rail can be made of steel to ensure strength and durability.

In another embodiment of the invention, the bracket can include two separate plates fastened together, as shown in FIGS. 4-8. The following discussion applies to FIGS. 4-8 and the same reference numerals denote the same structure in each drawing, but from different viewpoints. This embodiment includes a first plate 102 with an opening 106 that is configured to receive a snow fence rail. A first plurality of protrusions 104 are located in a base region below the opening. The first plurality of protrusions can be oriented toward the standing seam of the standing seam roof.

This embodiment also includes a second plate 110 that is on an opposite side of the standing seam as compared to the first plate. A base region of the second plate can have a plurality of protrusions 112 that are oriented opposite the first plurality of protrusions. According to one embodiment of the invention, the second plate also has an opening 114 above the second plurality of protrusions. One or more fasteners 118*a-c* are configured to fasten the first plate to the second plate so that the first and second plurality of protrusions are pressed into the standing seam roof to affix the snow bracket device onto the roof.

A spacer 108 can be positioned between the first and second plates. In this embodiment, the spacer is a width of the standing seam of the roof, which helps equalize pressure throughout areas of contact between the standing seam and the first and second plurality of protrusions. The fastener can pass through the spacer in order to hold the spacer in place between the two plates or other spacer and fastener configurations can be used.

An additional fastener 118*c* can be located to form a triangular pattern with two protrusions 112, 113. This distributes the pressure between the two points and provides extra strength for the bracket in clamping on the roof.

Figure 4:
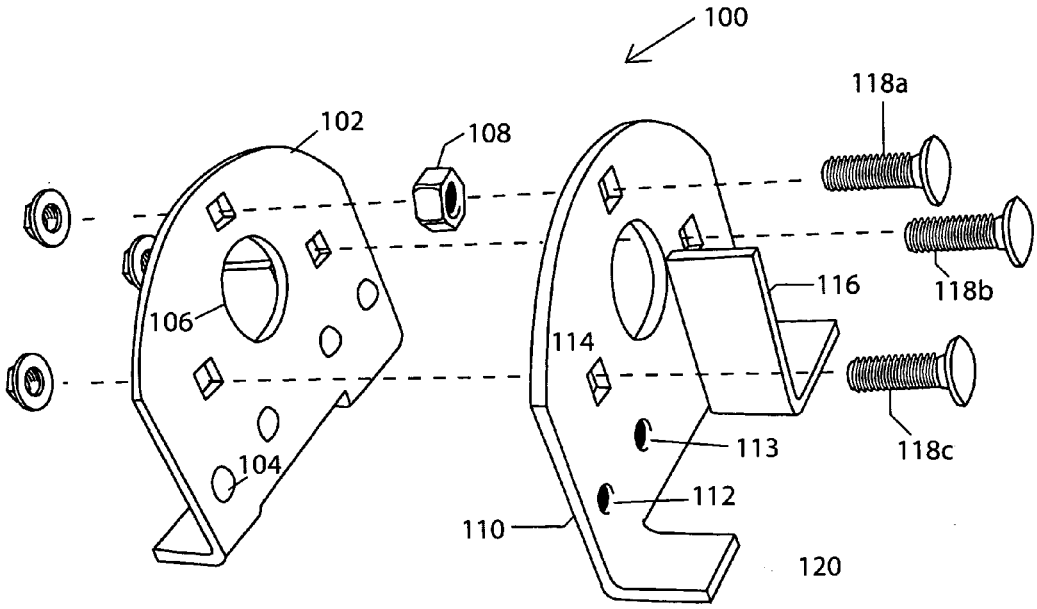
FIG. 4 is an exploded view of an embodiment of a snow fence bracket according to the present invention.
Figure 5:
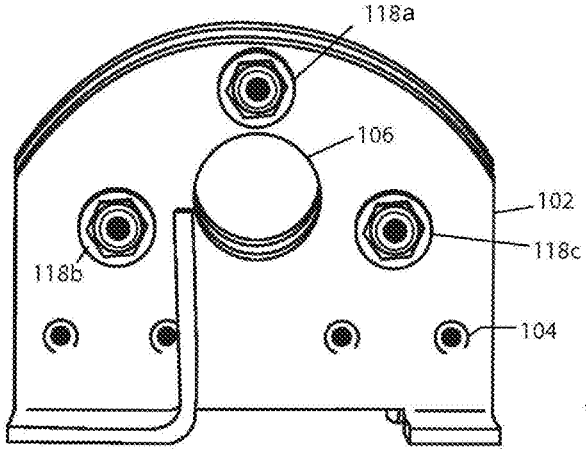
FIG. 5 is an orthogonal side view of an embodiment of a snow fence bracket of the present invention.
Figure 6:
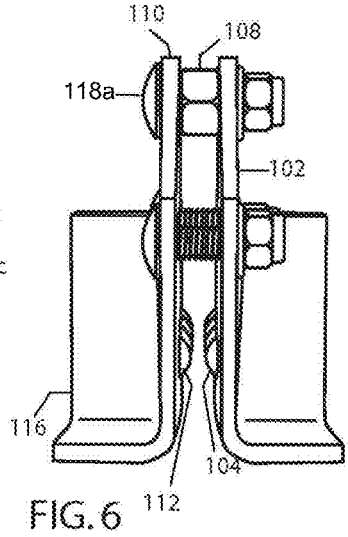
FIG. 6 is another orthogonal side view of a snow fence bracket according to an embodiment of the present invention.
Figure 7:
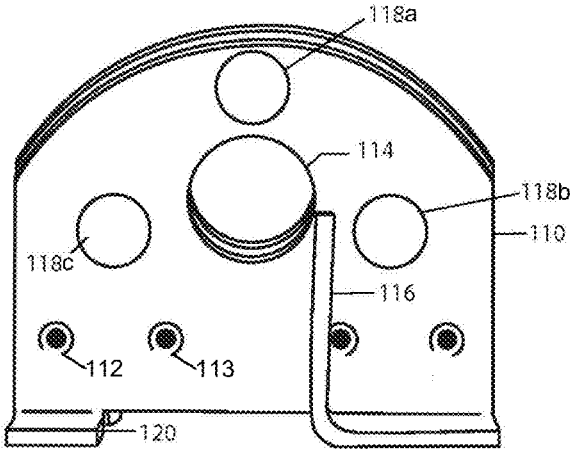
FIG. 7 is an edgewise view of a snow fence bracket according to an embodiment of the present invention.
Figure 8:
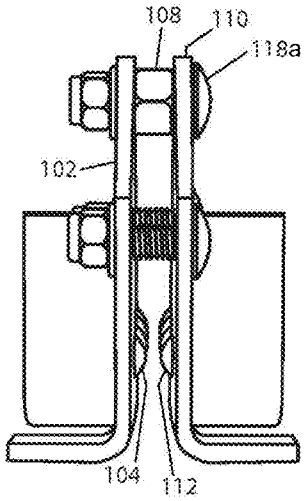
FIG. 8 is another edgewise view of a snow fence bracket according to an embodiment of the present invention.

One or both of the plates can include a snow stop 116 as shown on the second plate in FIG. 4. The snow stop is fixed to either the first or second plate (or a snow stop can be on both plates) and is located at least partially under the snow fence rail. The snow stop is configured to prevent snow and ice from sliding under a snow fence rail. A snow fence rail blocks snow and ice, but when snow or ice is below the snow fence rail, the snow or ice may slide under the rail and still be dangerous to people and property. The snow stop retains this snow and ice on the roof until it safely melts.

The snow stop 116 can be attached to the plate or plates using a fastener or welding. Alternatively, the snow stop can be an integral part of the plate, as shown in FIG. 4. According to one embodiment of the invention, the snow fence bracket is configured so that the snow stop is supported by the snow fence rail. This gives the bar additional strength from the rail and safely holds back snow and ice that would otherwise slide under the rail.

The bracket can optionally include a stabilizing foot 120 that is attached to the bracket at an area where the bracket comes in contact with the standing seam roof. The stabilizing foot helps to keep a plate upright when it is being attached to the other plate. Moreover, the stabilizing foot helps to keep the plates stable when positioned over the seam. The stabilizing foot can be on one of the plates, both of the plates, or on neither of the plates. The plates can be made of steel to provide durability and strength.

Figure 9:
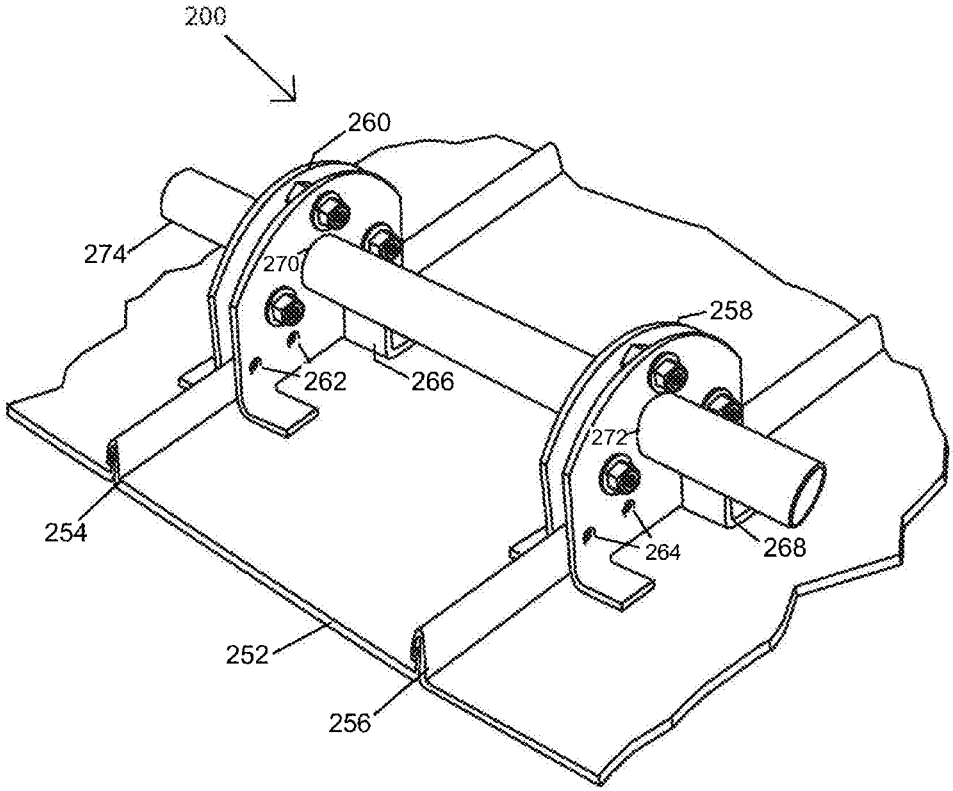
FIG. 9 is a perspective view of an embodiment of a snow fence device according to the present invention.

FIG. 9 illustrates an assembled snow fence on a standing seam roof 252. A plurality of brackets can be used in conjunction with a snow fence rail 274 to create a snow fence 200. The first bracket 260 has an opening 270 configured to receive a snow fence rail and includes a plurality of protrusions 262 that are pressed into a first standing seam 254 to attach the bracket to the roof. A second bracket 258 is included and has an opening 272 configured to receive a snow fence rail. The second bracket includes a second plurality of protrusions 264 that are pressed into a second standing seam 256 to attach the second bracket to the roof. The snow fence rail passes through the openings in the first and second brackets and is supported by the brackets.

The first bracket can also include a snow stop 266 that is configured to stop snow and ice from sliding beneath the snow fence rail. A second snow stop 268 can be included for the second snow fence bracket. To ensure the integrity of the fence, the first bracket can be mounted to the standing seam roof within 36 inches of the first bracket. When brackets are affixed to the roof at distances of approximately 12 to 36 inches apart, this avoids putting too much pressure on any one point of the roof which may cause the bracket or the rails forming the fence to fail and can better avoid causing damage to the roof. The distances between the brackets can be based on engineering calculations for the roof slope, roof sheathing material, roofing fasteners, projected snow load, and roofing panel lengths.

A first additional opening can be included in the first bracket, and a second additional opening can be included in the second bracket (not shown). These additional openings are configured to receive a second snow fence rail. The fence can include a second snow fence rail that passes through the additional openings above the first snow fence rail. A second snow fence rail can provide additional height for the snow fence and keep snow or ice from passing over the snow fence. In areas where a lot of snow is accumulated on the roof, this is a valuable additional element.

The snow stops 266, 268 can extend away from the standing seam 254, 256 and at least partially span a gap between the standing seam roof and the snow fence rail. A stabilizing foot can be an integral part of the snow stop. In one embodiment of the invention, the stabilizing foot, the plate, and the snow stop are all part of the same piece of material.

Figure 10:
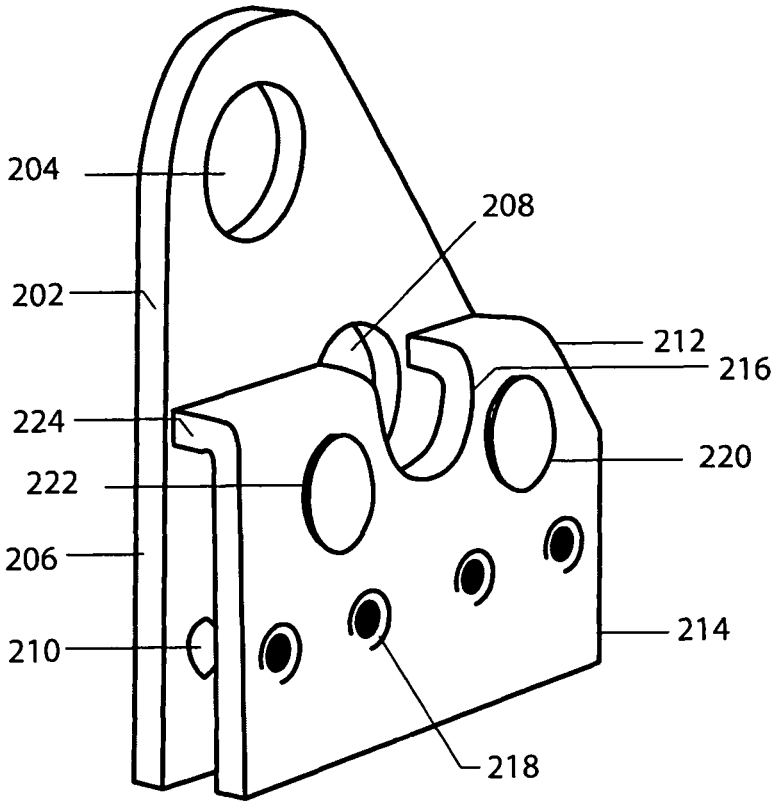
FIG. 10 is a perspective view of a hinge bracket device for a snow fence according to an embodiment of the invention.

FIG. 10 illustrates a bracket device for mounting on a standing seam of a roof and supporting a snow fence rail. In this embodiment, a plate with a hinge is provided, and this avoids the need for a spacer or an additional fastener as discussed in the previous embodiments. The bracket device includes a first plate 202 with an opening 204 and a base region 206 that is located substantially below the opening. The opening in the first plate can be configured to receive a snow fence rail. Further, one or more additional openings 208 can be provided in the first plate to receive an additional snow fence rail. Adding additional snow fence rails allows the bracket device to retain more snow than would otherwise be possible with a single rail. The number of openings for the rails can be determined by the engineering design of the bracket and is not limited to any specific number of rails. For example, four or five rails can be a useful embodiment with the bracket because of the increased amount of snow that can be retained on the roof.

A first plurality of protrusions 210 are provided in the base region of the first plate. The first plurality of protrusions can be oriented towards the standing seam of the roof. A second plate can be provided 212 that also has a general base region 214. The second plate can be configured with a second opening 216 to receive a snow fence rail. However, it is not necessary for the second plate to have any opening for the snow fence rail.

A second plurality of protrusions 218 can be provided in the base region of the second plate 214. The second plurality of protrusions can be oriented opposite the first plurality of protrusions 210. Furthermore, the second plurality of protrusions may or may not be included depending on the amount of retaining strength or friction needed to be provided against the seam of the standing seam roof.

At least one fastener 220 is configured to fasten the first plate 202 to the second plate 212 so that the first plurality of protrusions 210 and the second plurality of protrusions 218 are pressed into the standing seam of the roof. A second fastener 222 or even a third fastener may be provided in order to give added strength to the bracket device. Instead of including a spacer as previously used, the present embodiment provides a hinge region 224 on the second plate that creates the appropriate spacing for a standing seam.

One valuable result of using a hinged plate is that one hinge can be used for many thicknesses of standing seams. This means that the end user of the bracket device does not need to purchase a separate spacer or an additional fastener for each bracket based on the width or thickness of the standing seam on the roof. The hinge enables the bracket to clamp down on various sizes of seams with the hinge acting as a levered spacer.

Figure 11:
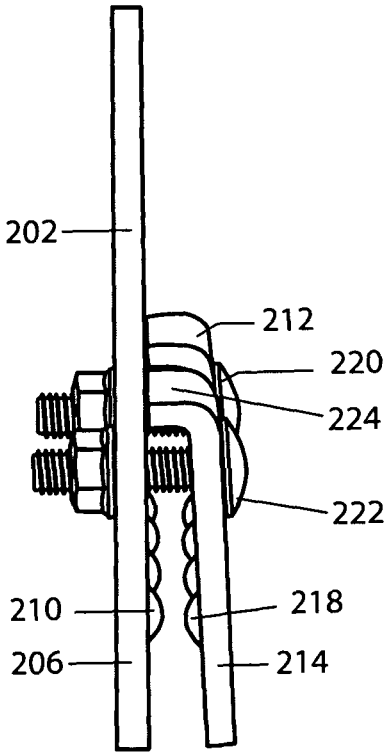
FIG. 11*is* an edgewise view of the embodiment of a hinge bracket.
Figure 12:
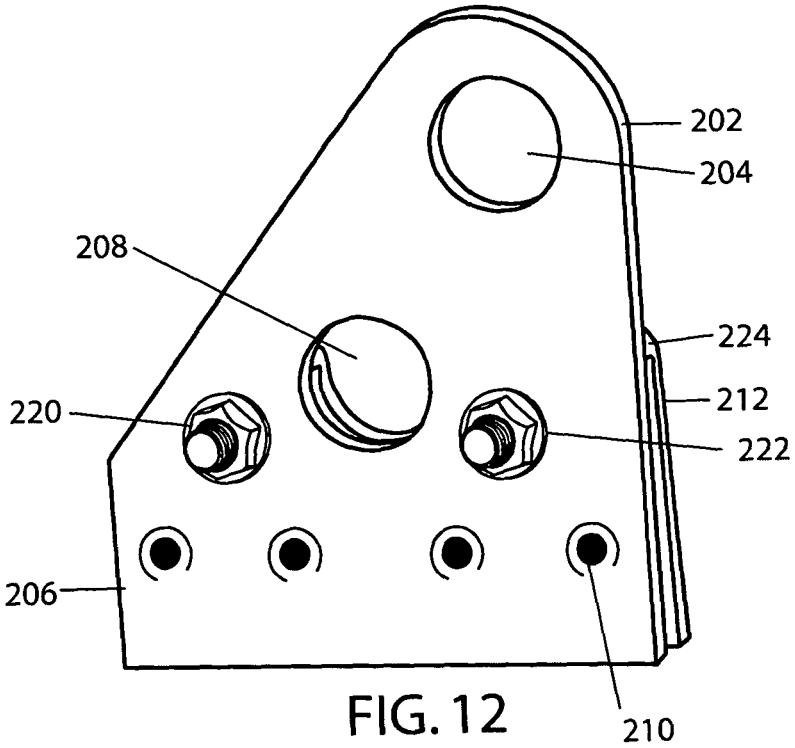
FIG. 12 is an orthogonal side view of an embodiment of a hinge bracket device for a snow fence.
Figure 13:
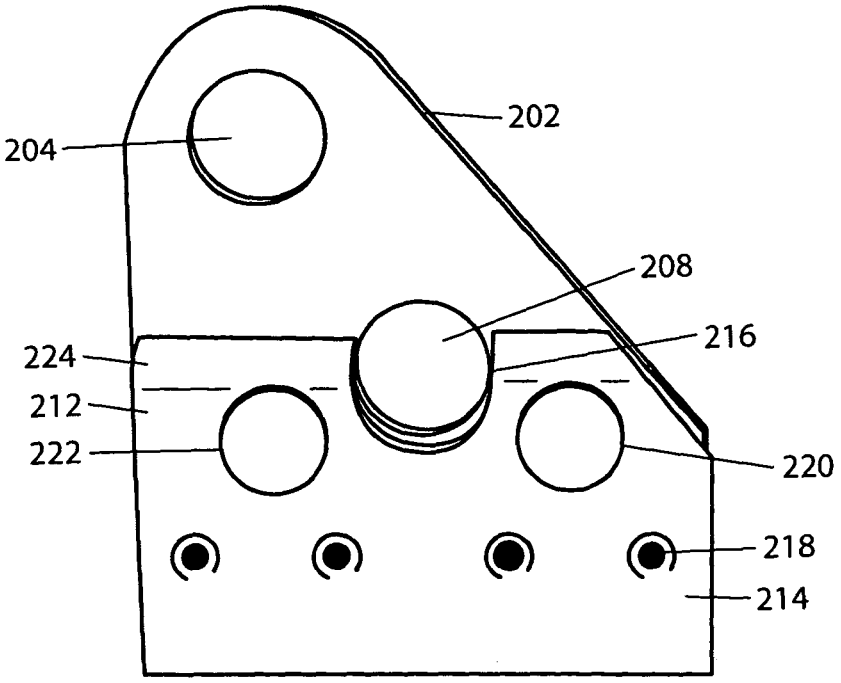
FIG. 13 is an additional side view of a hinge bracket for a snow fence device according to the present invention.

FIG. 11 illustrates an edgewise view of the hinge bracket device. Structure in FIG. 11 corresponding to structure described for FIG. 10 is labeled correspondingly. FIGS. 12 and 13 are a left orthogonal side view and a right orthogonal side view of the hinged bracket device and are numbered corresponding to FIGS. 10 and 11.

Figure 14:
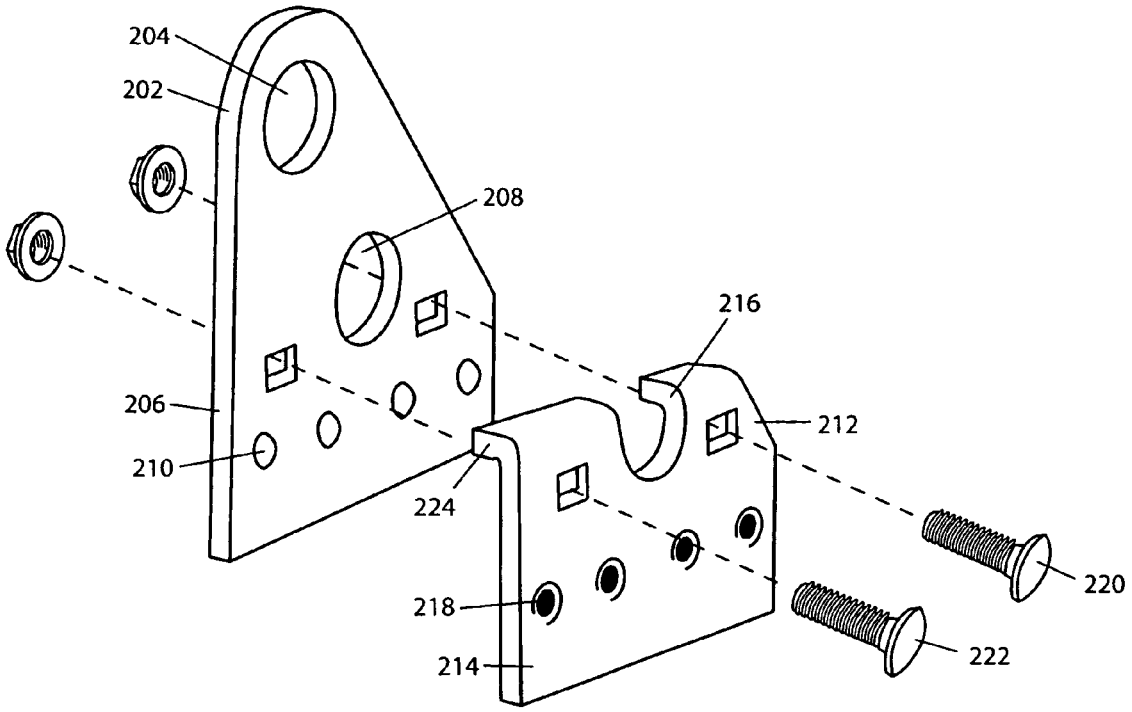
FIG. 14 is an exploded perspective view of an embodiment of a snow fence device with a hinged plate.
Figure 15:
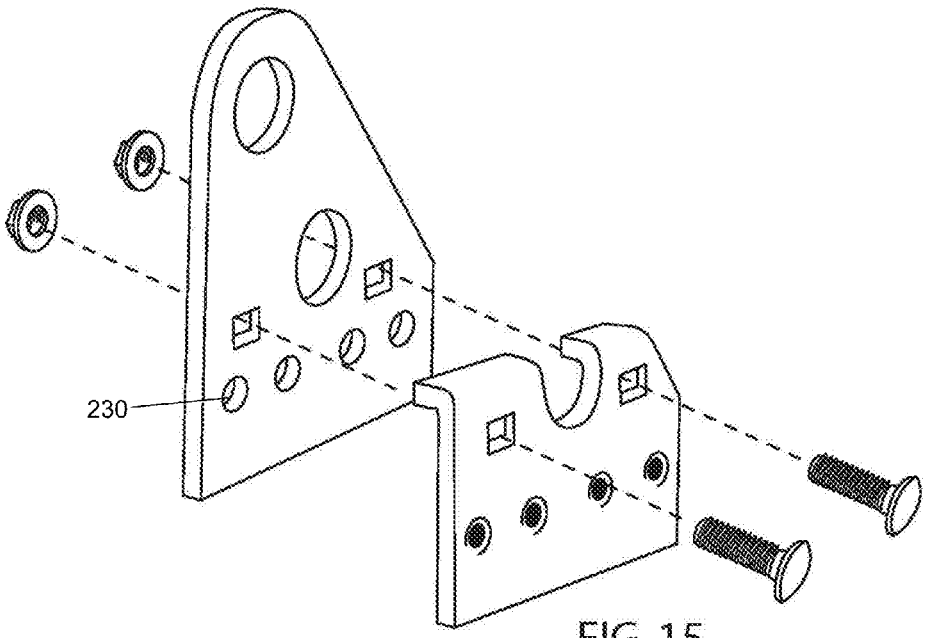
FIG. 15 is an exploded perspective view of an embodiment of a snow fence device with a hinge plate and holes formed in the device.
Figure 16:
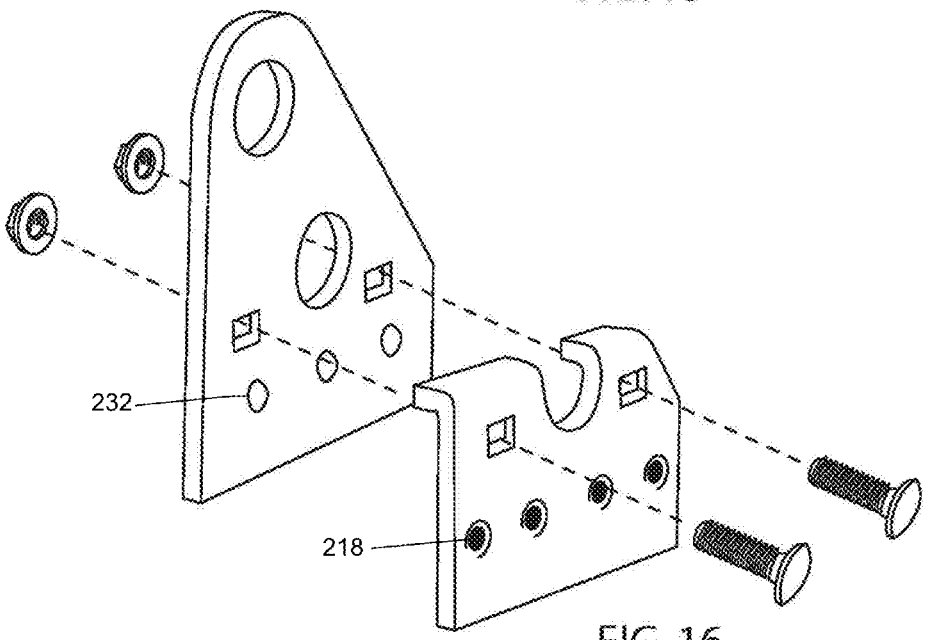
FIG. 16 is an exploded perspective view of an embodiment of a snow fence device with a hinge plate with offset protrusions.

FIG. 14 shows an exploded view of the bracket device with a hinge configuration, and the corresponding structure is numbered to correspond with FIGS. 10-13. FIG. 15 includes a plurality of holes or recesses 230 that are formed in the device (instead of a plurality of first protrusions) and the second plurality of protrusions can push the seam material into the holes to produce a holding force. FIG. 16 illustrates that the first plurality of protrusions 232 can be offset from the second plurality of protrusions 218 in order to create an offset frictional force against a standing seam of a roof. In other words, staggered bumps or points can be used in a snow fence device to create additional holding strength.

The present invention further includes a method for engineering a snow fence device system. Engineering for the fail points of an entire roofing system is valuable because even if the snow fence device can retain the projected amount of snow on the roof, there are other parts of the roof that may fail. A roofing material failure may completely circumvent the benefits of the snow fence device. As a result, it is important to identify the properties of the roof sheathing that forms the roof. Another step is determining the fail points of roof panels and fasteners that are attached to the roof sheathing. The roof panels and fasteners should be engineered and selected to withstand the load that will be placed on them by the bracket and snow. Fail points of a bracket should also be determined because the bracket supports the snow fence rail. Once all of these variables are known, then it is possible to calculate whether the combination of the roof sheathing, roof panels, fasteners and bracket with the snow fence rail are able to support an estimated amount of snow. Additional variables that can be included in this calculation are roof slope and roofing panel length which can be used in estimating the amount of snow the roofing materials, bracket, and snow fence rail are able to support. These calculations can be made in computer software or by a business consultant.

Figure 17:
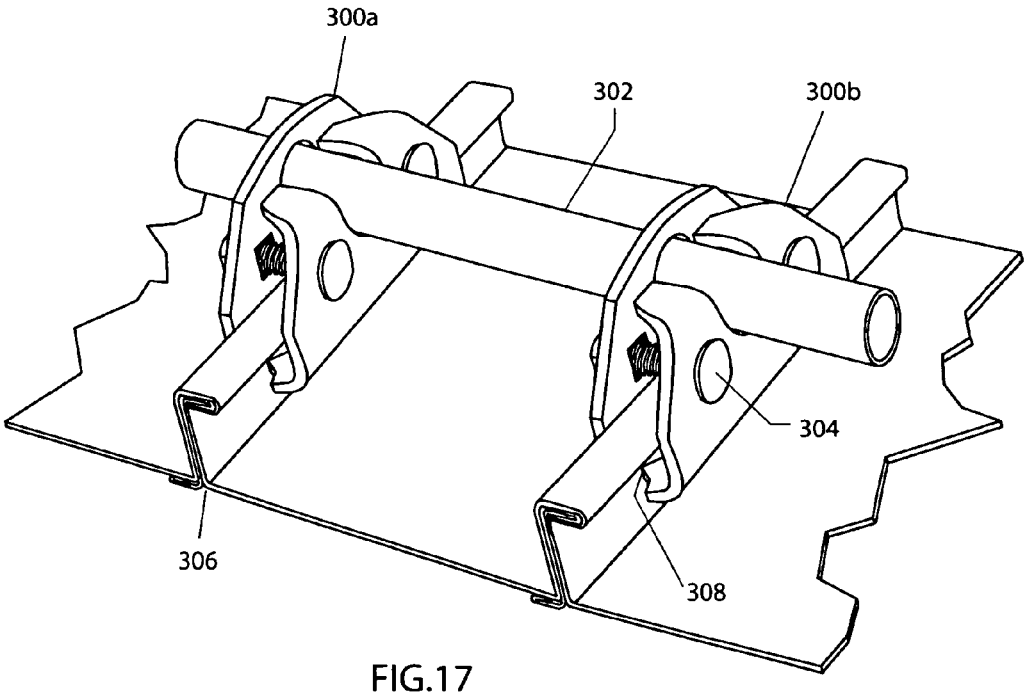
FIG. 17 is a perspective view of an embodiment of a snow fence device with a hinge plate and toothed retaining portion.

FIG. 17 further illustrates a snow fence with two snow brackets 300*a* and 300*b*. The two brackets are attached to a standing seam roof 306 and support one or more rails 302 of a snow fence. One or more bolts or fasteners 304 are used to attach each bracket to the standing seam. In this embodiment, one or more teeth 308 are used as the protrusions to attach the bracket to the seam. Using teeth on a plate of the snow bracket can create a good clamping interface between the bracket and the standing seam. In addition, the teeth provide a significant amount of resistance and can hold a considerable amount of weight when snow is resting against the snow fence. The teeth may be located on just the first plate of the bracket or there may be complementary teeth on the second plate of the bracket. If there are complementary teeth, the complementary teeth may be either aligned or staggered as compared to the first set of teeth. In addition, the teeth have been found to be generally more effective if they are installed below the hem of the standing seam roof.

The rail of the snow fence can rest inside the first plate as shown in FIG. 17 or the rail(s) may be configured in a higher position so the rail only passes thorough one plate. A snow stop can also be used with this toothed bracket embodiment and the snow stop can be formed into one of the plates or separate snow stops can be attached to the snow fence rails. The snow fence brackets illustrated in FIG. 17 also enable the bracket to clamp onto standing seams of varying thicknesses.

Another type of roof that can use a snow fence with snow brackets is a roof covered with a PVC (polyvinyl chloride) membrane or another thermoplastic material. These vinyl sheeting roof coverings are often laid over a metal deck sub-roof, a metal B deck, a corrugated roof, or some other roof surface that has a certain amount of slope. The vinyl sheeting can be reinforced with polyester and contain stabilizers or pigments. "Thermoplastic" means that when heated sufficiently, the material temporarily changes from a solid to a semi-solid state. This enables the sheets or panels that are overlapped to be fused together and return to a solid state upon cooling, yielding one continuous membrane. It is this quality that enables the seam overlaps of vinyl roof membranes to be fused or heat-welded together.

The vinyl sheeting can include insulation or fleece backing and may be a few inches thick. The sheets of vinyl can also be heat welded together to form a continuous roof covering. To accomplish the welding, specialized, electrically-powered welding equipment that is either self-propelled or handheld is used. These units operate on electricity and inject heated air into the seam area, softening the membrane surfaces. A roller that is either hand-held or part of the self propelled unit presses the seam overlap together. As the welder moves away from a given seam location, the membrane quickly cools down to ambient temperature and the heat weld is made, providing a watertight bond.

Figure 18:
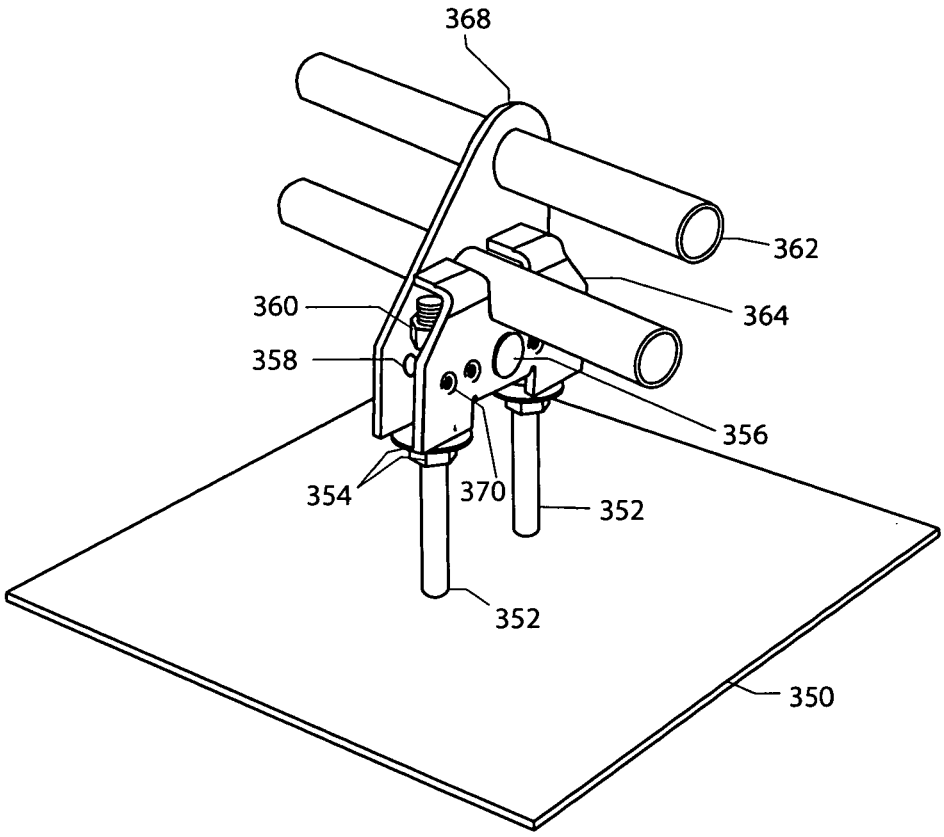
FIG. 18 is a perspective view of a clamp-on snow fence that is mounted on bolts according to the present invention.
Figure 19:
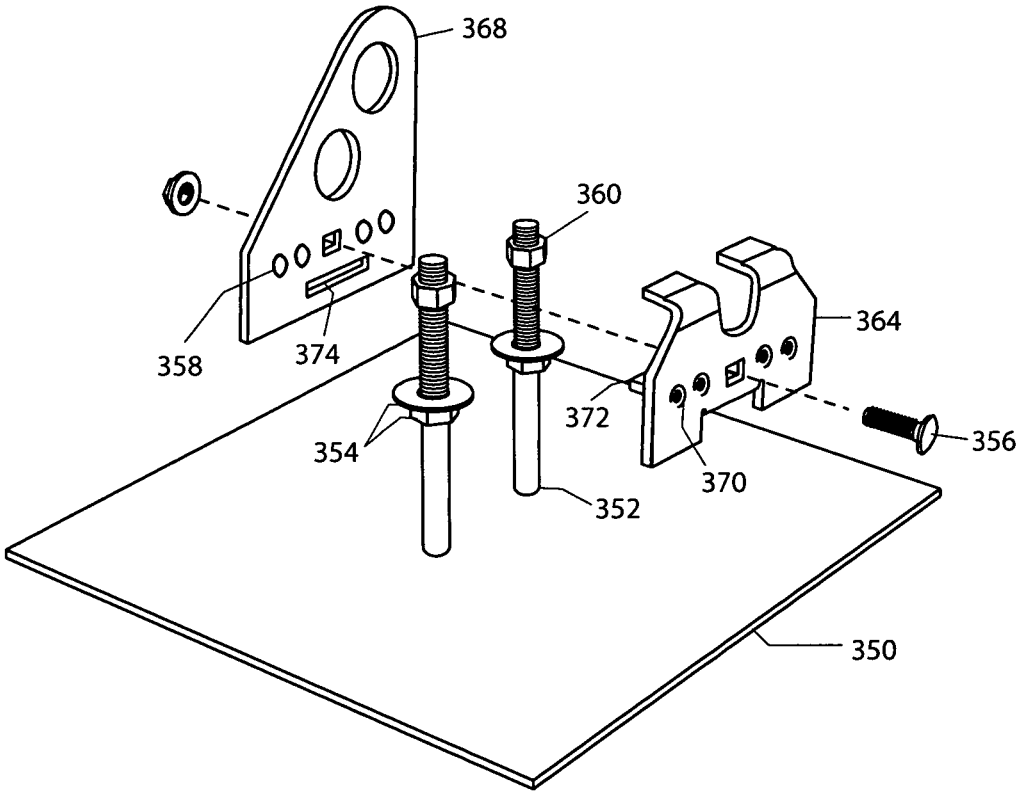
FIG. 19 is an exploded perspective view of a clamp-on snow fence device that is mounted on bolts as in the present invention.

In order to provide a bracket for a snow fence on a thermoplastic roof, a bracket that avoids compromising the integrity or watertight seal of the vinyl or thermoplastic roofing material is valuable. FIGS. 18 and 19 illustrate a perspective view and an exploded view of a clamp-on bracket and anchoring system for a vinyl roof. The clamp-on bracket system includes a metal base plate 350 with rib bolts 352 welded or otherwise attached to the metal plate. The base plate can be attached to the metal B deck roof or other sub-roof as desired by the roofing installer. For example, the base plate can be welded to the metal B deck roofing or holes can be drilled through the metal B deck roofing in order to bolt the base plate to the roof.

The rib bolts 352 are threaded at the top to allow nuts to be threaded onto the bolt as depth guides and spacers. Particularly, a guide nut and washer 354 can be placed on the bolt at the desired height above the plate and can serve as a depth guide and/or support for the bracket. The bracket includes a first plate 364 with a first plurality of protrusions 370 in the surface of the first plate. The first protrusions are aligned to surround the bolt. A second plate 368 also has protrusions 358 that correspond to the spacing of the first protrusions and surround the bolt from the opposing side in order to fasten the bracket to the bolt. The first plate can be clamped in a hinged manner against the second plate using one or more clamping bolts 356. Alternatively, a spacer can be used instead of a hinge as illustrated by previous embodiments described herein. A top nut 360 can also be used to retain the hinge on the bolt. The top nut helps retain the protrusions (and clamp) on the bolt and stops the bracket from being pushed off the bolt by expanding ice or other external forces. In addition, the top bolt can act as a spacer for the two bracket plates. FIG. 19 further illustrates that a stabilizing slot 374 and stabilizing flange 372 can pass between both of the bolts and further aid in retaining the bracket on the bolts.

When the base plate and rib bolts are attached to the metal deck, a patch can be heat-welded around the rib bolts and onto the vinyl roof covering. This patch provides a skirt that surrounds the bolts and creates a watertight seal for the roof. In addition to the rib bolts, the bracket (as illustrated in FIGS. 18 and 19) can also be attached to other retaining devices such as pins, thick metal strips, plastic flanges, spikes, or other retaining pieces that are attached to the roof deck through the vinyl.

Figure 20:
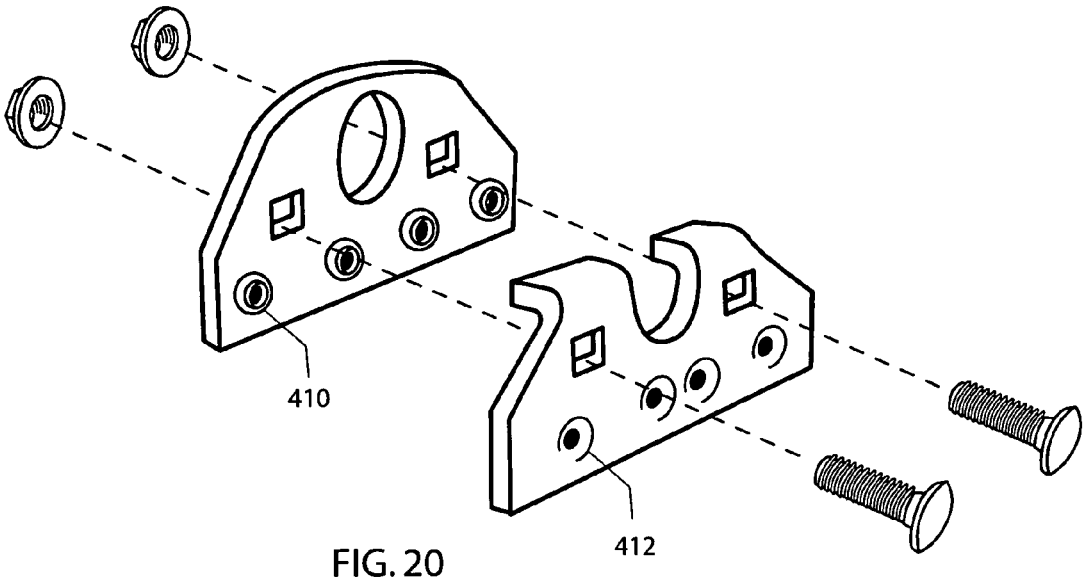
FIG. 20 illustrates an exploded perspective view of a snow fence device that uses a circular burr.

FIG. 20 illustrates an exploded perspective view of a snow fence device that uses one or more circular burrs 410. The circular burrs provide additional holding force because the burr can be clamped into a standing seam to provide additional strength. Particularly, the burr may be manufactured using a hole punch such that a comparatively sharp edge is formed on the inside edge of the burr. The burr edge aids in securing the snow fence device to the standing seam.

Figure 21:
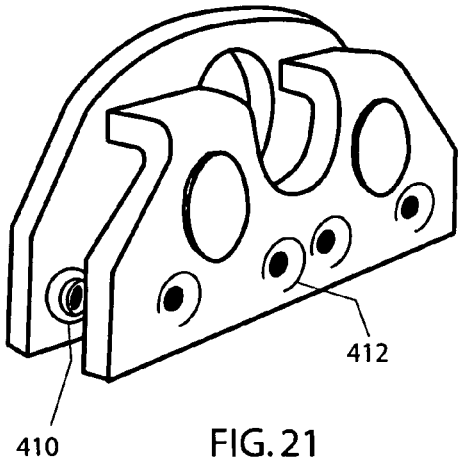
FIG. 21 illustrates an assembled perspective view of a snow fence device that uses a circular burr.

FIG. 21 illustrates an assembled perspective view of a snow fence device that uses a circular burr. Although FIG. 20 and FIG. 21 illustrate staggered burrs, the protrusions 412 and burrs on the face opposing the burrs can also be aligned.

The thickness of the brackets for the snow fence devices and clamping mechanisms illustrated in the present invention may be thicker or thinner than illustrated in the present drawings. In addition, any combination of protrusions, teeth, burrs, or may be used in a bracket to secure the snow fence devices.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A bracket device operable to mount on a standing seam of a roof and support a snow fence rail, comprising:

a first plate with an opening and a base region, the opening being configured to receive the snow fence rail;

a first plurality of protrusions integrally formed in the base region of the first plate, wherein the first plurality of protrusions are oriented toward the standing seam;

a second plate with a second opening and a base region, the second opening being configured to receive the snow fence rail;

a second plurality of protrusions integrally formed in the base region of the second plate, wherein the second plurality of protrusions are oriented opposite the first plurality of protrusions; and a spacer positioned between the first plate and the second plate;

at least one fastener configured to fasten the first plate and the second plate using the spacer so that the first plurality of protrusions and the second plurality of protrusions are pressed into the standing seam of the roof, wherein the plurality of protrusions further comprises at least two protrusions arranged in a triangular pattern with a secondary fastener.

* * * * *